United States Patent [19]

Larsen

[11] 4,018,393

[45] Apr. 19, 1977

[54] MOUNTING FOR GRINDER LINERS

[75] Inventor: Darrell R. Larsen, Salt Lake City, Utah

[73] Assignee: Minneapolis Electric Steel Casting Company, Minneapolis, Minn.

[22] Filed: Nov. 6, 1975

[21] Appl. No.: 629,503

[52] U.S. Cl. ..... 241/182; 241/300

[51] Int. Cl.[2] ..... B02C 17/22

[58] Field of Search ..... 241/182, 183, 284, 299, 241/300

[56] References Cited

UNITED STATES PATENTS

| | | | |
|---|---|---|---|
| 1,534,000 | 4/1925 | Baker | 241/183 |
| 1,872,036 | 8/1932 | Hardinge | 241/182 X |
| 3,462,090 | 8/1969 | Landes et al. | 241/299 |
| 3,582,007 | 6/1971 | Heighberger | 241/183 |
| 3,630,459 | 12/1971 | Slegten | 241/183 |
| 3,804,346 | 4/1974 | Norman | 241/300 X |

FOREIGN PATENTS OR APPLICATIONS

| | | | |
|---|---|---|---|
| 47-4388 | 3/1967 | Japan | 241/182 |

*Primary Examiner*—Roy Lake
*Assistant Examiner*—Howard N. Goldberg
*Attorney, Agent, or Firm*—Merchant, Gould, Smith, Edell, Welter & Schmidt

[57] ABSTRACT

A new procedure and apparatus for securing shell liners in ball and bar mills. The liners are formed with sockets of special shape at predetermined intervals therealong, and are held within the shell of the mill by bolts having heads, received in the sockets, and threaded shanks passing through the liners and the mill shell to nuts on the outside. The sockets and heads are shaped to provided continuous flat contact areas of substantial size regardless of variations in center distances of holes axially along the shell (i.e., the mounting holes are larger than the mounting bolt heads).

7 Claims, 8 Drawing Figures

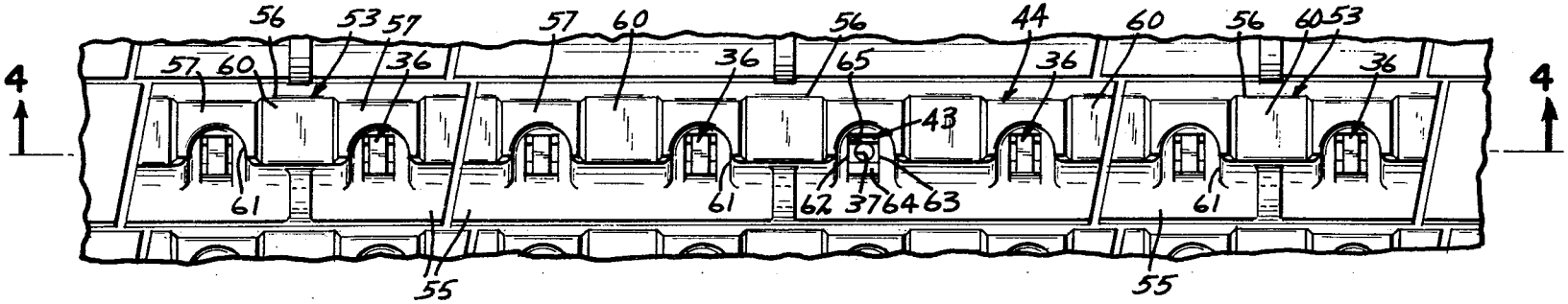
FIG. 3
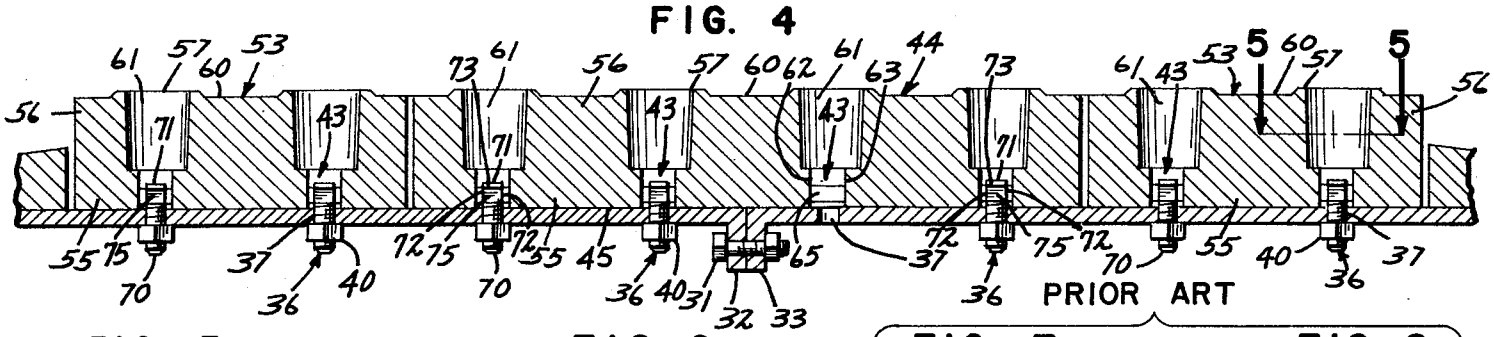
FIG. 4
PRIOR ART
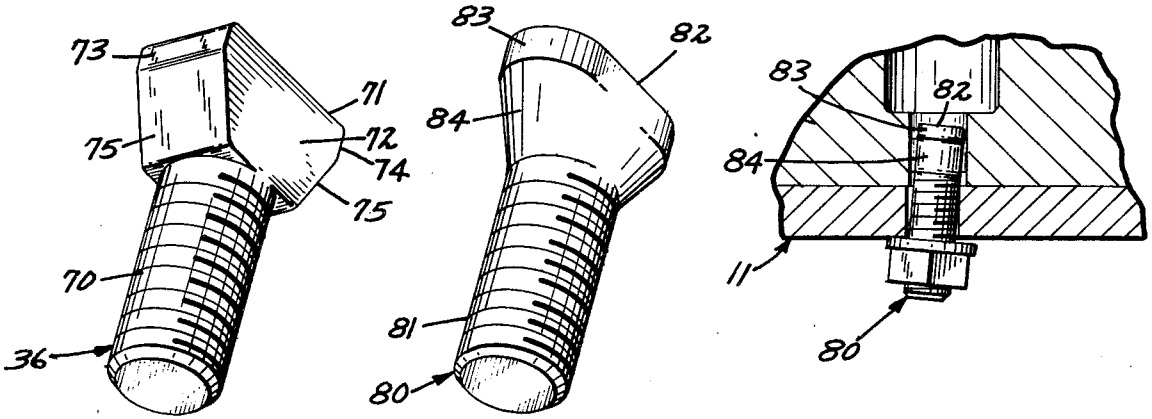
FIG. 8
FIG. 7
FIG. 6
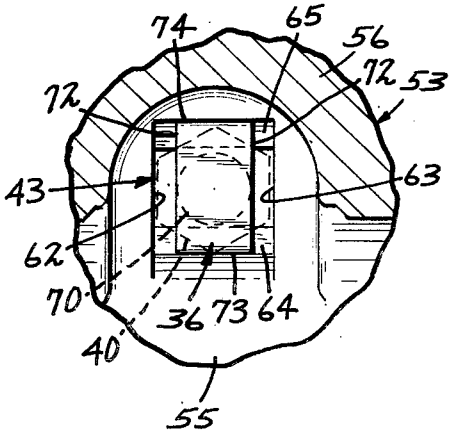
FIG. 5

MOUNTING FOR GRINDER LINERS

BACKGROUND OF THE INVENTION

This invention relates to the field of grinding, and more specifically to a new and more convenient method and means for securing liners in the large bar mills and ball mills used to comminute ore in commercial mining operations.

A mill of this sort comprises an enormous drum or hollow cylinder mounted on bearings for rotation about a substantially horizontal axis and driven by a very powerful motor through conventional reduction gearing. The ends of such a mill are hollow: material to be comminuted is continuously fed into the mill at one end and the comminuted product continuously emerges at the other end.

Naturally, it is important to keep the mill in operation for as extended intervals as is possible between shut downs for maintenance. The ores being comminuted are highly abrasive, however, and for practical service life, it is necessary that the drum be lined with a special sheet of highly abrasion-resistant character, which must also be tough enough to stand the repeated rolling impact of the ore fragments and of the steel bars or balls, loose in the drum, whose impact is added to the autogeneous grinding of the ore itself.

In view of the tremendous size of the mills, it is necessary to form the lining of a plurality of components, each small enough to be handled - that is, to be inserted into the grinder through one of the axial openings, and to be positioned in a desired location therein - with equipment available at the site of the grinder.

End liners are necessary of course, but do not comprise the subject matter of this application, which relates rather to the lining of the cylindrical surface itself. It has been found that grinder efficiency is improved when the inner surface of the lining is not smooth, but rather is provided with ridges extending axially. A lining is thus constructed of a plurality of liners, or bars, of the special steel extending along the drum. Limitations of size and weight ordinarily do not permit the liners to be of the full length of the drum. These liners, which are subject to the greatest wear and hence most frequently require replacement, are designed to be secured to the inside of the drum by both having their heads received in sockets cast into the steel at known intervals therealong, and passing through holes appropriately located in the shell of the drum, for engagement by nuts extending therethrough.

The securement of the liners without the drum offers certain problems which are not immediately evident. In the first place, the mere size of these mills presents practical difficulties. An illustrative example of such an installation is a ball mill 12 feet long and 28 feet in diameter. In addition to the end liners, 72 rows of liners extend axially within the drum: they are cast from special steel and weigh about 3600 pounds per row. Thus, the drum must support a self-load over 250,000 pounds in addition to the charge of ore and balls or bars, which may add several hundred thousand pounds further. To support so massive a load for rotation at speeds in the neighborhood of 10 revolutions per minute, the drum is formed of steel plates from 1 inch to 1½ inches in thickness.

The size limit on availability of steel plate, the capacity limit of metal forming machines, and the transportation limits of constructing a mill capable of being shipped from the factory to its remote user, combine to dictate that such a drum may not be unitary. The foregoing mill may be considered exemplary: it is built in two axial sections, each made up of cylindrical quadrants of the chosen axial dimension. After the quadrants are rolled to the desired curvature and axial side flanges and quadrantal curved flanges are welded thereto, each section is positioned on a boring mill to be machined for truing the arcuate flanges and for drilling angularly spaced rows of mounting holes for the linear mounting bolts, at axial intervals equal to those between the sockets in the liners. The same process is repeated for as many cylindrical quadrants as are required to make up the desired length of drum, each section being trued and drilled separately. The flanges are provided with aligned bolt holes for use in assembling the components into a unitary structure.

When the components making up the drum are received at the site where it is to be used, the quadrants are assembled by bolts along the axial flanges to form cylinders, and the cylinders with end plates as necessary are assembled by bolts along circumferential flanges to make up the drum, after which the liners are to be inserted. The circumferential joints along the lengths of the drums are recognizable weaknesses in the complete structure, and it would be desirable to compensate therefor by arranging at least some of the liners to bridge the joints and to be secured within the drum on both sides of the joints. The hole spacing in the drum is determined by the spacing of sockets in the liners, which in casting can be held to an acceptable tolerance. It has been found in practice, however, that while the tolerances for axial spacing of mounting holes in any one cylindrical section of the drum are within practically acceptable limits, the spacing between adjacent mounting holes in axial line but on opposite sides of a circumferential joint cannot be maintained within such limits with the presently available technology. Of course, if one hole across the joint is out of position, any others of that liner on that side of the joint are also out of position by the same amount, within accepted tolerances. This means that no particular trouble is to be anticipated in fastening a liner to the drum as long as it does not extend on both sides of a circumferential joint. If it does so extend, the sockets in the liner may be aligned readily with the holes in the drum on either one side of the joint or the other, but not with holes in both sides of the joint at the same time. It is accordingly been the custom to design the pattern of liners so that no liner extends across a circumferential joint. This obviates the difficulty of hole and socket alignment, but the liners give no reinforcement to the drum itself at the important joint areas.

Some attempts to provide for this situation have been made. The bolt holes are usually made larger in diameter than the bolts, which allows for a certain amount of linear shifting of the bolt in the hole and socket, and which permits a certain degree of cocking of the bolts as they pass through the drum. Cocking is undesirable as it not only tends to sheer the parts as they are driven together, but also causes "ovaling" of the mounting holes in the drum, as well as quickly abrading the bolt shanks just under the heads, and results moreover in undesirable stress distribution in the drum, the casting, and the bolts.

There have also been suggested certain particular configurations of bolt heads and liner sockets which are intended to give some degree of freedom of angulation of the bolt axis. These expedients have proved helpful for minor out-of-tolerances such as a cure in the circumferential alignment of the bars and holes, but not for such major discrepancies as unavoidably occur in the axial direction.

It is not practical to drill out any holes in the liners at the time of erection as by their very nature the bars are extremely resistant to the abrasion of cutting tools. Moreover, because of their composition and hardness, the liners cannot be cut acceptably with torches. On the other hand, relocation and reboring of holes in the drum on the site, with the repeated insertion and removal of the massive liners for trial purposes which is incidental thereto, is an intolerably expensive and arduous process.

SUMMARY OF THE INVENTION

The present invention proposes a new and inventive combination of bolt head and bolt socket, permitting installation of truly directed bolts in the mill shell which nevertheless engage at their heads with cast socket surfaces of liners in substantially flat contact areas of useful magnitude, without causing distortion forces in the bolt, the liner, or the shell, and over a range of variation in hole location hitherto unobtainable. By the use of this arrangement it is possible to design liner segments which bridge across circumferential joints, thus adding to the structural strength of the hole mill.

Various advantages and features of novelty which characterize the invention are described with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawing.

FIG. 3 is a fragmentary view showing the lining of a mill according to the invention viewed radially outwardly;

FIG. 4 is a fragmentary view in section taken along the line 4—4 of FIG. 3;

FIG. 5 is an enlarged view of the head of a bolt according to the invention and the surrounding parts; as seen from line 5—5 of FIG. 4;

FIG. 6 is a perspective view of such a bolt;

FIG. 7 is a view like FIG. 6 showing a bolt according to the prior art; and

FIG. 8 is a view showing one of the bolts according to FIG. 7, installed as necessary to hold a liner bar in a shell when hole positioning is out-of-tolerance.

DESCRIPTION OF THE PREFERRED EMBODIMENT

Figure 1:
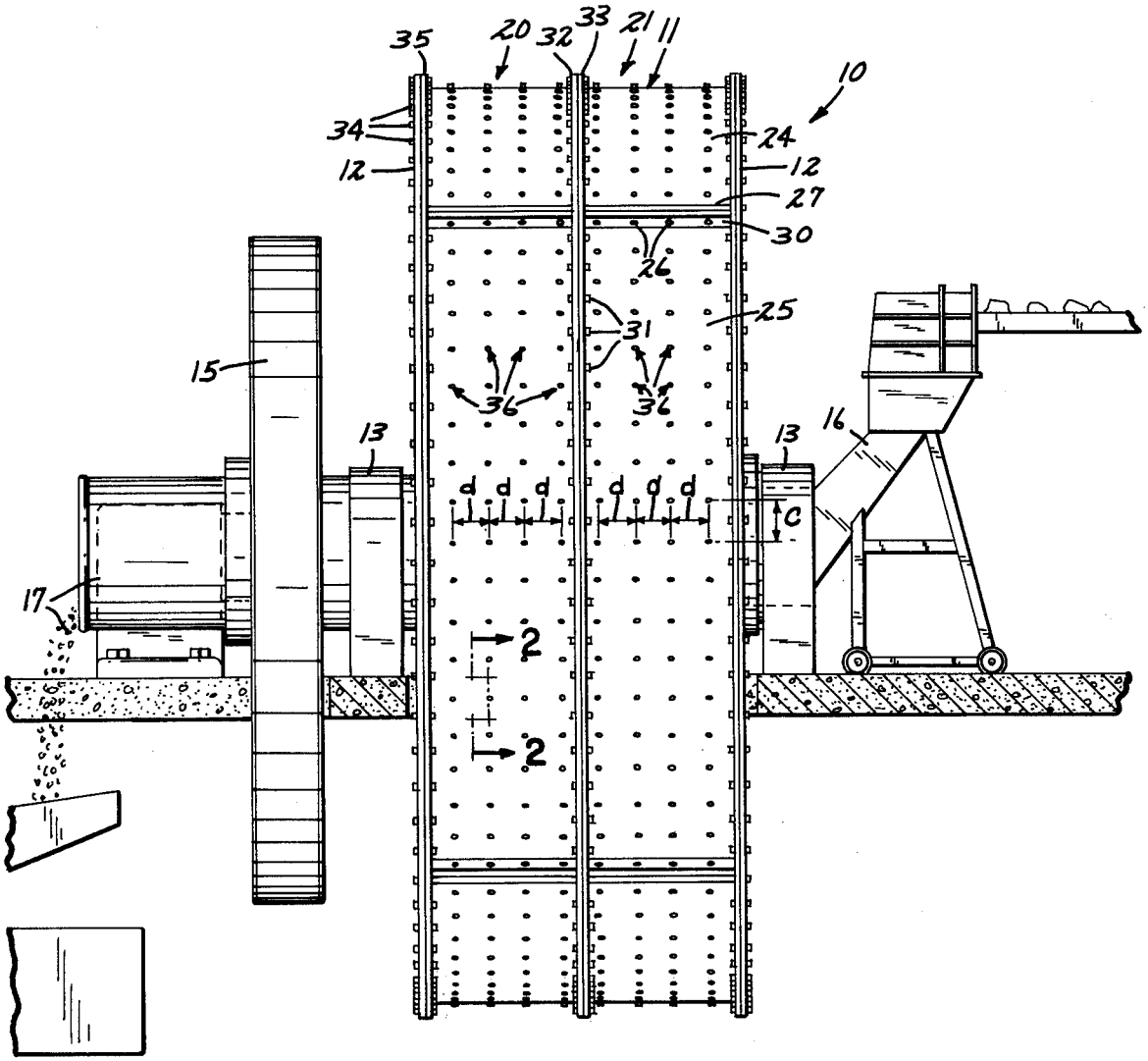
FIG. 1 is a somewhat schematic side view of a ball mill embodying the present invention.

Referring now to FIG. 1, a ball mill 10 with which my invention is designed for use is shown schematically to comprise a hollow drum or shell 11, closed by end walls 12 having large central apertures, and arranged for rotation about a substantially horizontal axis in suitable bearings 13 by a drive of conventional nature in a suitable housing 15. Material to be comminuted is supplied to one end of mill 10 through an appropriate chute 16, and the comminuted material appears at the other end, as indicated at 17.

As shown in the figure, drum 11 is made up of a plurality of cylindrical sections 20 and 21, each of which is in turn assembled from a set of cylindrical quadrants by bolts extending through axial flanges. For example, the quadrants 24 and 25 of section 21 are secured together circumferentially by bolts 26 passing through axially directed flanges 27 and 30, respectively, while sections 20 and 21 are secured together axially by bolts 31 passing through circumferential flanges 32 and 33 secured to the two drum sections. The drum is completed by end plates secured to the circumferential flanges of the end drum sections, as plate 12 is secured by bolts 34 to flange 35 of section 20.

A plurality of liner mounting bolts 36 extend outwardly through mounting holes 37 of drum 10, to threadly receive nuts 40. The holes are positioned in a pattern defining axial rows, spaced angularly about the drum by circumferential chords c, and circumferential rows, spaced linearly along the drum by axial distances d. Ordinarily, the chords c are all equal, as are all the distances d, the former being determined by the width of a liner shown in FIG. 2, and the latter by the spacing of mounting sockets cast into the liners. The mounting holes 37 are longer in diameter than the bolts passing through them; for example, 2 inch holes may be bored for traversal by 1¾ inch bolts. To avoid confusion in the drawing, only a representative number of the holes, bolts, and nuts are shown.

Figure 2:
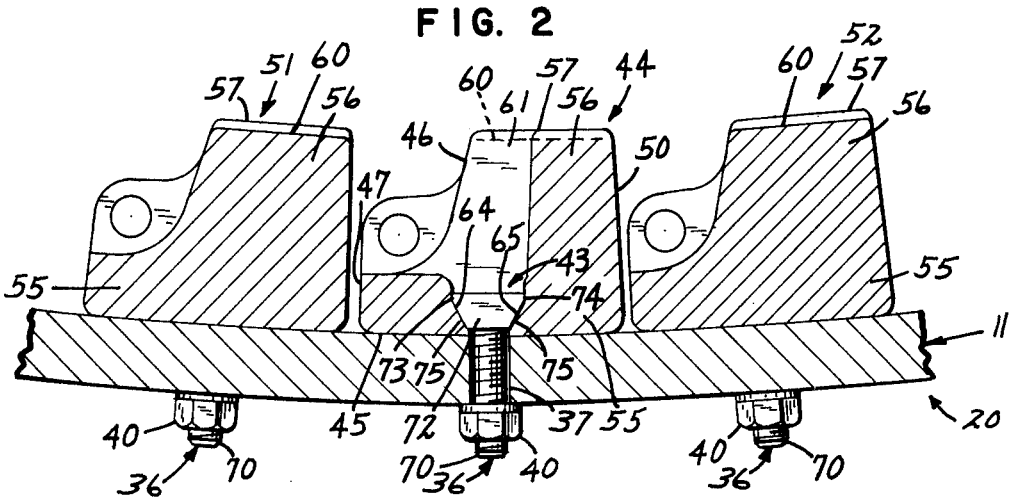
FIG. 2 is a fragmentary transverse sectional view generally along the line 2—2 of FIG. 1.

FIG. 2 is a fragmentary transverse section generally at the side of the drum of FIG. 1, the section passing through one of the mounting bolts in a first liner and somewhat to the left of the bolts in two adjacent liners. Liner 44 is of cast steel of special formulation, the longitudinal axis of the bar being perpendicular to the paper as seen in the figure. The liner has an outer mounting surface 45 which is preferably curved to the inside radius of the drum, an inner grinding surface 46 of irregular contour, and surfaces 47 and 50 for apposition with adjacent liners 51 and 52.

A fragmentary view showing the drum lining as seen from within the drum appears in FIG. 3. A liner row is shown to be made up of end liners 53 aligned with center liner 44, which spans the joint of flanges 32 and 33. Mounting bolts 36 are shown in positions to hold the liners to the inside of the drum 10, and pass through sockets 43 in the liners and mounting holes 37 in the drum. One of the central mounting bolts is omitted in FIG. 3 to show the holes more clearly.

As is shown in these figures and FIG. 4, each liner includes a body 55 from which rises a narrower grinding and tumbling ridge 56, having slightly raised teeth 57 separated by somewhat lower spaces 60. Each space 60 is cut away to the level of body 55 in an arcuate recess 61 which partially surrounds a bolt socket 43.

Socket 43 is generally oblong in section and has a pair of straight walls 62 and 63 generally perpendicular to the axis of the liner, and separated, in the direction of the axis of the liner, by a distance considerably greater than the diameter of bolt 36. The bolt socket has a second pair of walls 64 and 65 which at least in part taper inwardly to define a pair of flat areas perpendicular to the first pair of walls and converging in the outward direction toward a line of intersection passing through the axis of the hole.

As shown in FIG. 6, bolt 36 has a threaded shank 70 and a head 71 with a pair of flat parallel surfaces such as surface 72, and a pair of surfaces 73 and 74 which are in part tapering inwardly toward shank 70, as at 75. Surfaces 75 of bolt head 72 engage walls 64 and 65 of hole 37 in a pair of flat areas of useful magnitude, while permitting a considerable degree of axial displacement of the bolt in the hole, as determined by the excess, over the bolt diameter, of the distance between flat faces 62 and 63. Thus, shank 67 may at all times extend perpendicularly through drum 11 and hold the liner to the shell without undesired distortion stresses, permitting ready erection of the mill at the site because all the mounting bolts will be able to pass through openings in the liners and the shell which are effectively aligned.

FIG. 7 is a showing of the prior art bolt 80 having a threaded stem 81 and a head 82. The outer end of head 82 is of the same width as the diameter of the bolt, but its length is approximately twice as great. After a short portion 83 of constant cross-sectional area the head tapers down in a complex curve 84 to the stem 81. The sockets or mounting holes in the grinder bars in this case are a mechanical fit with the bolt heads, and an acceptable stress distribution is accomplished with these bolt heads and sockets as long as the sockets and bolt holes are aligned within rather narrow limits.

FIG. 8 is a schematic showing to suggest what happens if misalignment occurs. The apertures are larger than the bolt shanks so that the bolts can be inserted or driven into position, except for gross deviations from tolerance. However, the shank must be cocked in the apertures, so that the contact between the old head and its socket changes from a superficial one of relatively large area to a deformed one where the contact area approaches a line or even a point. The words line and point are used mechanically rather than mathematically, and recognize that some transverse dimension is necessary. Nevertheless, the stress concentrations here may become locally enormous, with the concomitant effect on the structure.

From the above it will be clear that I have invented a new and improved combination of bolt head and socket which permits bolts to remain perpendicular to the face of the mill drum, and gives plane contact areas between the bolt and the socket of significant magnitude, even in the presence of deviations of the positions of the bolt holes in the shell far greater than any heretofore tolerable.

What is claimed is:

1. In combination:

a liner for a grinding mill comprising a casting of tough, abrasion resistant material having a longitudinal axis, inner and outer grinding and mounting surfaces respectively, and a plurality of mounting apertures spaced axially therealong and extending from said grinding surface through said mounting surface, each of said apertures being generally oblong in the longitudinal direction and being defined by a first pair of opposed walls generally perpendicular to and extending through to said mounting surface, and a second pair of opposed walls tapering inward at least in part toward and extending through said mounting surface, the distance between the walls of said first pair extending in the direction of the axis of the liner;

and a plurality of mounting bolts each comprising a threaded shank dimensioned to pass through said aperture and extend beyond said mounting surface, and a head having a first pair of opposed surfaces generally conforming in shape to the first pair of aperture walls, the distance between the first pair of aperture walls being sufficiently large relative to that of the first pair of bolt head surfaces to permit adjustable bolt head movement in the longitudinal direction, and a second pair of opposed surfaces tapering inward for conforming engagement with the second pair of aperture walls.

2. The combination defined by claim 1, wherein the first pair of aperture walls and first pair of bolt head surfaces are planar and mutually parallel.

3. The apparatus defined by claim 2, wherein the first and second pairs of bolt head surfaces are mutually perpendicular.

4. The combination defined by claim 3, wherein the first pair of bolt head surfaces are generally tangent to said shank.

5. In combination:

a hollow cylindrical grinder shell including a plurality of mounting holes arranged in circumferential rows;

a plurality of liners for said shell, each liner comprising a casting of tough, abrasion resistant material having a longitudinal axis, inner and outer grinding and mounting surfaces respectively, and a plurality of mounting apertures spaced axially therealong and extending from said grinding surface through said mounting surface, each of said apertures being generally oblong in the longitudinal direction and being defined by a first pair of opposed walls generally perpendicular to and extending through to said mounting surface, and a second pair of opposed walls tapering inward at least in part toward and extending through to said mounting surface, the distance between the walls of said first pair extending in the direction of the axis of the liner;

and mounting bolts securing said liners within said shell to extend therealong in the directions of said rows of holes, each of said mounting bolts comprising a threaded shank dimensioned to pass through said aperture and extend beyond said mounting surface to engage a nut outside the shell, and a head having a first pair of opposed surfaces generally conforming in shape to the first pair of aperture walls, the distance between the first pair of aperture walls being sufficiently large relative to that of the first pair of bolt head surfaces to permit adjustable bolt head movement in the longitudinal direction, and a second pair of opposed surfaces tapering inward for conforming engagement with the second pair of aperture walls.

6. In combination:

a liner for a grinding mill comprising a casting of tough, abrasion resistant material having a longitudinal axis, inner and outer grinding and mounting surfaces respectively, and a plurality of mounting sockets spaced axially along the liner and extending from said grinding surface through said mounting surface, each of said sockets being generally oblong in the longitudinal direction and being defined by a first pair of opposed walls generally perpendicular to and extending through to said mounting surface, and a second pair of opposed walls tapering inward at least in part toward and extending through to said mounting surface, the distance between the walls of said first pair extending in the direction of the axis of the liner;

and a plurality of mounting bolts, each comprising a threaded shank dimensioned to pass through said apertures and extend beyond said mounting surface to engage nuts along said shell, and a head having a first pair of opposed surfaces generally conforming in shape to the first pair of aperture walls, the distance between the first pair of aperture walls being sufficiently large relative to that of the first pair of bolt head surfaces to permit adjustable bolt head movement in the longitudinal direction;

and a second pair of opposed surfaces tapering inward for conforming engagement with the second pair of aperture walls.

7. A hollow cylindrical grinder shell including a plurality of mounting holes arranged in circumferential rows;

a plurality of liner elements for each shell, each element comprising a casting of tough, abrasion resistant material having a longitudinal axis, inner and outer grinding and mounting surfaces respectively, and a plurality of mounting sockets spaced axially along the element and extending from said grinding surface through said mounting surface, each of said sockets being generally oblong in the longitudinal direction and defined by a first pair of opposed walls generally perpendicular to and extending through to said mounting surface, and a second pair of opposed walls tapering inward at least in part toward and extending through to said mounting surface, the distance between the walls of the first pair extending in the direction of the axis of the liner element;

and mounting bolts securing said elements within said shell to extend therealong in the direction of said rows of holes, said bolts having heads received in said sockets and shanks passing through said shell to engage nuts outwardly thereof, the relation between said socket and said bolt heads being such as to permit adjustable movement of the bolt in the axial direction of the elements for significant distances without cocking of said shanks.

* * * * *

UNITED STATES PATENT AND TRADEMARK OFFICE

CERTIFICATE OF CORRECTION

PATENT NO. : 4,018,393

DATED : April 19, 1977

INVENTOR(S) : Darrell R. Larsen

It is certified that error appears in the above-identified patent and that said Letters Patent are hereby corrected as shown below:

Column 4, line 27, the word "longer" should be changed to the word --larger--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*